US009953614B2

(12) United States Patent
Inoe

(10) Patent No.: US 9,953,614 B2
(45) Date of Patent: Apr. 24, 2018

(54) SIGNAL PROCESSING DEVICE AND SIGNAL PROCESSING METHOD

(71) Applicant: Panasonic Intellectual Property Management Co., Ltd., Osaka (JP)

(72) Inventor: Masanobu Inoe, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 87 days.

(21) Appl. No.: 14/948,420

(22) Filed: Nov. 23, 2015

(65) Prior Publication Data

US 2016/0148408 A1 May 26, 2016

(30) Foreign Application Priority Data

Nov. 26, 2014 (JP) ..... 2014-238624
Nov. 9, 2015 (JP) ..... 2015-219117

(51) Int. Cl.
*G09G 5/02* (2006.01)

(52) U.S. Cl.
CPC ..... *G09G 5/02* (2013.01); *G09G 2320/0666* (2013.01); *G09G 2320/0686* (2013.01); *G09G 2340/06* (2013.01)

(58) Field of Classification Search
None
See application file for complete search history.

(56) References Cited

U.S. PATENT DOCUMENTS

2004/0001634 A1* 1/2004 Mehrotra ..... G06T 9/00 382/232
2004/0128621 A1* 7/2004 Orihara ..... G06T 11/001 715/275
2007/0064279 A1* 3/2007 Nishida ..... H04N 1/62 358/462
2008/0231876 A1* 9/2008 Harada ..... H04N 1/41 358/1.9
2015/0168723 A1 6/2015 Eto et al.

FOREIGN PATENT DOCUMENTS

JP 2005-210325 8/2005
JP 2009-100270 5/2009
JP 2013-257457 12/2013

* cited by examiner

*Primary Examiner* — Kyle Zhai
(74) *Attorney, Agent, or Firm* — Wenderoth, Lind & Ponack, L.L.P.

(57) ABSTRACT

An extraction unit determines whether, in a display area of a display unit in which content data obtained from an acquisition unit are displayed, there is a character area in which an area occupied by a character has a proportion greater than a predetermined value. Based on color information of the character in an area which is determined to be the character area by the extraction unit, a setting unit sets a target color temperature when the content data is displayed. A converter changes an original color temperature of the content data to the target color temperature, based on the target color temperature set by the setting unit.

1 Claim, 13 Drawing Sheets

SIGNAL PROCESSING DEVICE AND SIGNAL PROCESSING METHOD

BACKGROUND

1. Field

The present disclosure relates to a signal processing method and a signal processing device for performing signal processing to content data to be input.

2. Description of the Related Art

Unexamined Japanese Patent Publication No. 2013-257457 discloses a display device, and a display controlling method and a program. The display device has a display unit that outputs an image signal, and a signal processor that performs controlling of the image signal to be output to the display unit. The signal processor performs controlling that gradually decreases a color temperature of the image signal in accordance with an elapsed time from an observation start time of the display unit. By decreasing the color temperature, it is possible to reduce a blue component, and to relieve fatigue of a user.

SUMMARY

The present disclosure provides a signal processing device which can reduce fatigue of a user watching content data being displayed.

A signal processing device of the present disclosure includes: an extraction unit which extracts, in a display area in which content data is displayed, a character area in which an area occupied by a character has a proportion greater than a predetermined value; a setting unit which sets, based on color information of the character in the character area, a target color temperature when the content data is displayed; and a converter which changes an original color temperature of the content data to the target color temperature.

A signal processing device of the present disclosure is effective in reducing fatigue of a user watching content data being displayed.

DETAILED DESCRIPTION OF THE PREFERRED EMBODIMENTS

In the following, exemplary embodiments will be described in detail appropriately with reference to the drawings. However, in some cases, the exemplary embodiments will not be described in detail. For example, in some cases, there will not be made unnecessarily detailed description on already well-known matters or redundant description on substantially identical configurations. This is to avoid the description from being unnecessarily redundant and thus to help those skilled in the art to easily understand.

Note that the inventor provides the accompanying drawings and the following description to help those skilled in the art to sufficiently understand the present disclosure, but does not intend to use the drawings or description to limit the subject matters of the claims.

First Exemplary Embodiment

In recent years, there are more chances than ever to read characters of newspapers and magazines, on a monitor or a screen of a tablet terminal. Reading characters on a screen for a long time often causes eye fatigue. It is being revealed that the eye fatigue is caused by a blue emission component (blue light) emitted from the screen. In order to reduce the fatigue of the user's eyes, it is effective to reduce the blue emission component, in other words, to lower a color temperature of the displayed image. Here, the blue emission component is a light component with a wavelength from approximately 400 nm to 500 nm inclusive.

However, when a background color of the displayed content data is a warm color and when a character color is a warm color, contrast of the character is accordingly low, and the character is not easy to see. Here, the warm color is red, orange, and a yellow-based color. For example, the warm color is a color in a hue range from 10RP (red-purple) via 5YR (yellow-red) to 10Y (yellow) in the hue circle of the Munsell color system.

Therefore, if the color temperature of content data is lowered with respect to the content data including a warm-colored character in order to reduce a blue emission component, the background color which is not a warm color becomes a warm color, whereby the character sometimes becomes less easy to see. Further, in a case that the content data originally has a warm-colored background color, a problem that the character becomes much less easy to see occurs.

To address this issue, the present disclosure describes how to set a color temperature when content data containing a warm-colored character are displayed.

In a first exemplary embodiment, description will be made on a case that the color temperature of the content data is set depending on whether the character is warm-colored or not warm-colored. In the following, the first exemplary embodiment will be described with reference to FIG. 1 to FIG. 8.

[1-1. Configuration]

Figure 1:
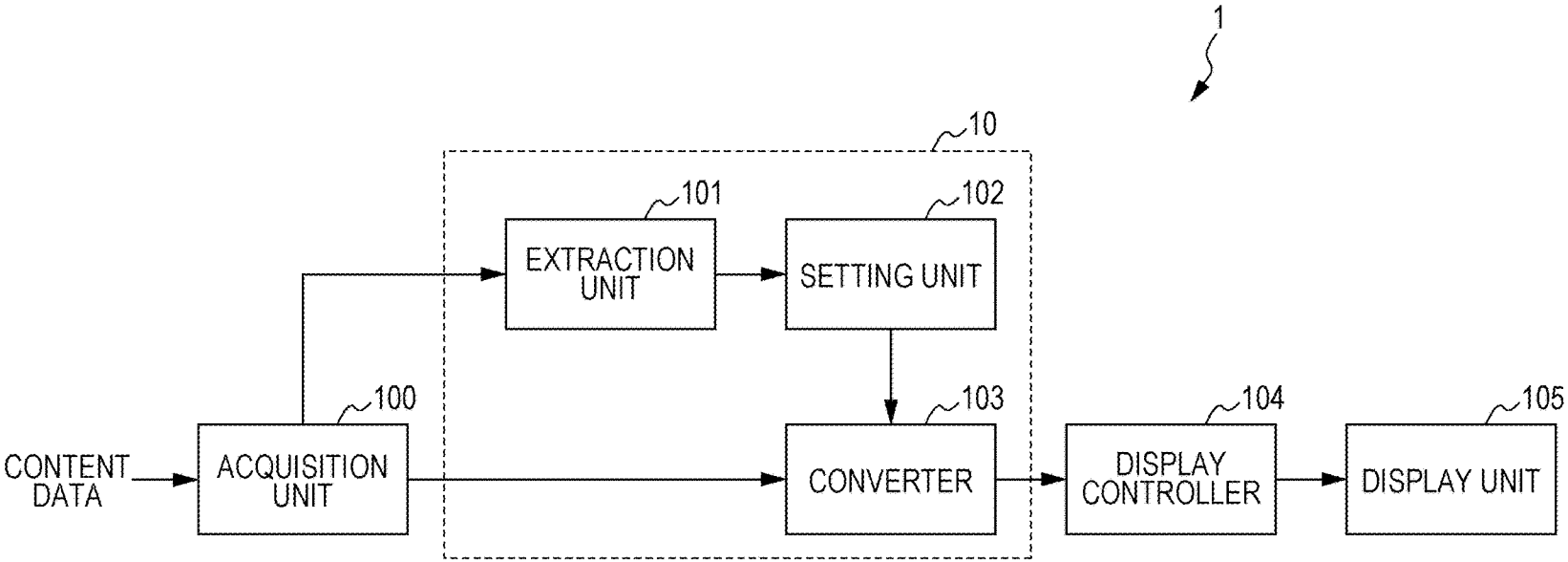
FIG. 1 is a block diagram showing a configuration example of a display apparatus having a signal processing device in a first exemplary embodiment.

FIG. 1 is a block diagram showing a configuration example of display apparatus 1 having a signal processing device in the first exemplary embodiment.

As shown in FIG. 1, display apparatus 1 includes acquisition unit 100, signal processing device 10, display controller 104, and display unit 105. In addition, signal processing device 10 includes extraction unit 101, setting unit 102, and converter 103.

Acquisition unit 100 is an input unit for inputting content data. Here, the content data are digital information represented by a video, an image, a character, or a combination of a video, an image, and a character. For example, the content data is data in a file format conforming to a standard such as MPEG, JPEG, PDF, and BMP.

Extraction unit 101 extracts a character area by dividing a display area in which the content data having been input from acquisition unit 100 into a plurality of areas and by determining whether each of the divided area is a character area in which an area occupied by characters has a proportion larger than a predetermined value. Here, the predetermined value is, for example, ½, which means that characters are displayed in ½ or more of the display area. Note that the proportion, for determining the area, of characters or other things than characters being displayed in the display area is not limited to ½.

Setting unit 102 sets a target color temperature obtained when the content data is displayed in accordance with color information of the characters in the character area extracted by extraction unit 101. Note that the color temperature represents the color when a grayscale including white is displayed; and when a color temperature is low, a reddish color is displayed, and when a color temperature is high, a bluish color is displayed. The color temperature in the present disclosure represents not only a color on a black body radiation locus shown on the chromaticity diagram but also a color on a coordinate including a neighborhood of a black body radiation locus of a so-called correlated color temperature.

Converter 103 changes an original color temperature of the content data to the target color temperature, depending on the target color temperature set by setting unit 102. The color temperature may be changed instantaneously to the target color temperature, but the color temperature may also be gradually changed to the target color temperature with lapse of time.

Display controller 104 performs a process to display the content data, whose color temperature has been changed in converter 103, on display unit 105 on the following stage.

Display unit 105 is a display and is configured by, for example, a liquid crystal display, an organic EL display, a plasma display, or the like.

[1-2. Operation]

An operation of signal processing device 10 configured as described above will be described in the following.

[1-2-1. Extraction of Area Performed in Extraction Unit]

Figure 2:
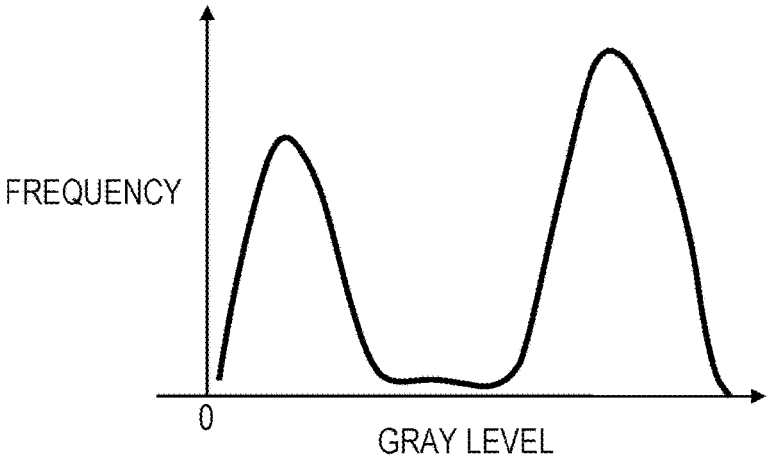
FIG. 2 is a diagram showing an example of a gray level histogram of a character area in the first exemplary embodiment.

FIG. 2 is a diagram showing an example of a gray level histogram of a character area in the first exemplary embodiment. In FIG. 2, the horizontal axis represents a gray level, and the vertical axis represents a frequency of each gray level. As shown in FIG. 2, the gray level histogram of the character area is roughly divided into two peaks which are respectively constituted by aggregated gray level values of a character part and a background part.

By using the characteristic of the gray level histogram shown in FIG. 2, extraction unit 101 determines whether the display area of a determination target is a character area. Here, the gray level may be made by totaling and averaging signal levels of RGB signals, or may be a luminance value obtained from the RGB signals. The luminance value is represented by following (Equation 1), for example.

$$\text{Luminance value}=0.3R+0.6G+0.1B \quad \text{(Equation 1)}$$

Here, in (Equation 1), R, G, and B represent signal levels of a red signal, a green signal, and a blue signal, respectively.

Further, extraction unit 101 may additionally perform determination, based on edge amounts in the area, in addition to the determination of the area, based on the gray level histogram. Extraction unit 101 performs the determination of the area by using the fact that there are many large edge changes in a character area.

[1-2-2. Operation of Setting Unit]

Figure 3:
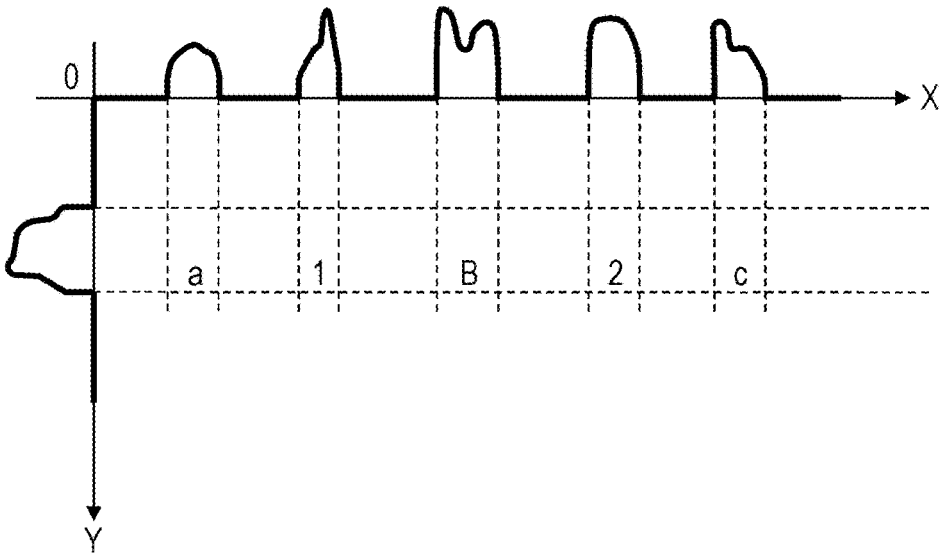
FIG. 3 is a diagram showing an example of a method for identifying characters in the first exemplary embodiment.

FIG. 3 is a diagram illustrating an example of a method for identifying characters in the first exemplary embodiment. FIG. 3 shows a part of a character area extracted by extraction unit 101. FIG. 3 shows a case of an obtained appearance frequency of the gray levels in the character part which is one of the two parts, into which the gray levels are divided in FIG. 2. In FIG. 3, the vertical axis Y represents the appearance frequency of the gray levels in the horizontal direction, and the horizontal axis X represents the appearance frequency of the gray levels in the vertical direction. FIG. 3 shows a character area in which five characters "a", "1", "B", "2", and "c" are arranged sequentially on a white background.

As shown in FIG. 3, in the area in which the characters exist, the appearance frequencies of the gray levels are high in the vertical direction and the horizontal direction. The background and the characters can be distinguished from each other by using the characteristics of the appearance frequencies of the gray levels. When the character signal can be distinguished in this way, a character color can be obtained from the RGB signals of the character signal.

Figure 4:
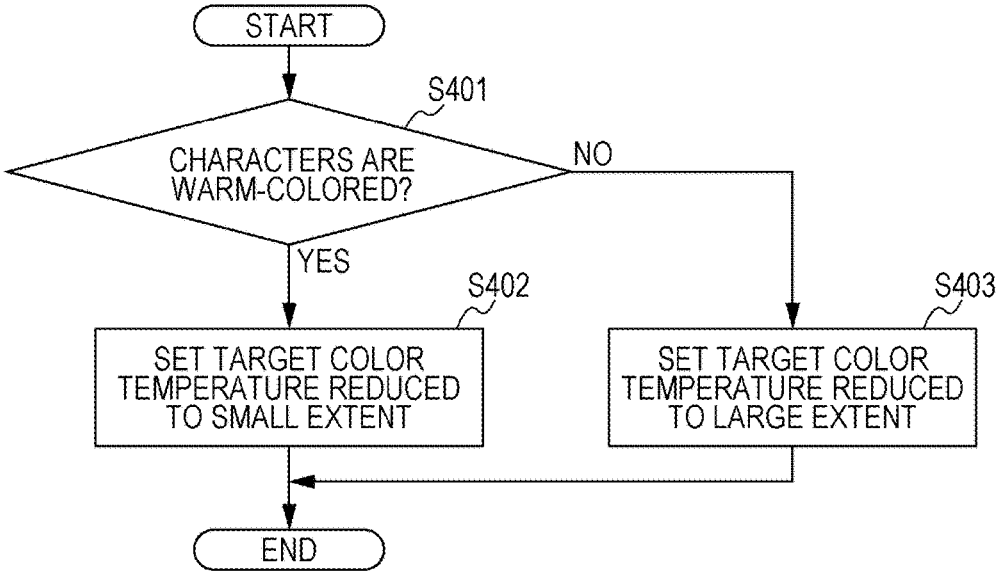
FIG. 4 is a flowchart illustrating an operation of a setting unit of the signal processing device in the first exemplary embodiment.

FIG. 4 is a flowchart illustrating the operation of setting unit 102 of the signal processing device in the first exemplary embodiment.

Setting unit 102 determines whether the characters in the character area are warm-colored (step S401). If setting unit 102 determines that the characters are warm-colored, setting unit 102 sets the target color temperature reduced to a small extent from the original color temperature (step S402). Alternatively, if setting unit 102 determines that the characters are not warm-colored, setting unit 102 sets the target color temperature reduced to a large extent from the original color temperature (step S403).

[1-2-3. Operation of Converter]

Figure 5:
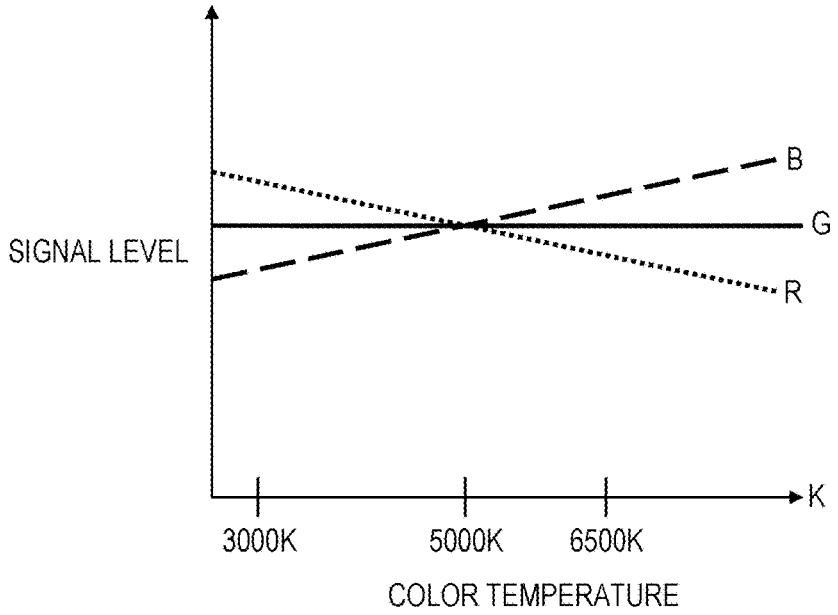
FIG. 5 is a diagram illustrating an example of a color temperature changing process of a converter of the signal processing device in the first exemplary embodiment.

FIG. 5 is a diagram illustrating an example of a color temperature changing process of converter 103 of the signal processing device in the first exemplary embodiment. FIG.

5 shows an example that if the RGB signals are set at the same level, the displayed color temperature is 5,000K. In order to change the color temperature, converter 103 performs a process in which each of the RGB signals is multiplied by a predetermined gain to change the ratios among the RGB signals. When the color temperature is to be increased, converter 103 makes a change in the direction of raising the level of the B signal and lowering the level of the R signal. When the color temperature is to be lowered, converter 103 makes a change in the direction of lowering the level of the B signal and raising the level of the R signal.

Figure 6:
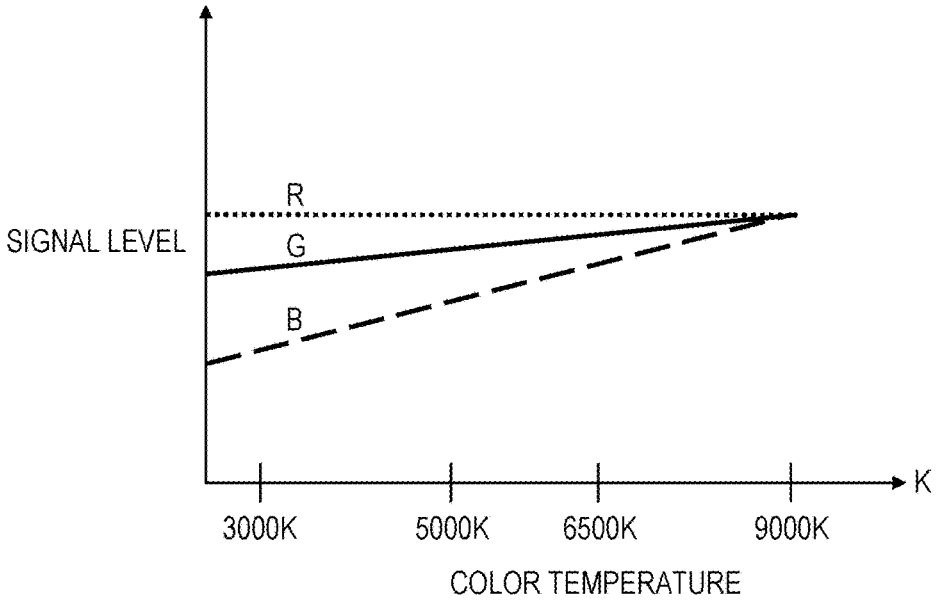
FIG. 6 is an explanatory diagram of another example of the color temperature changing process of the converter of the signal processing device in the first exemplary embodiment.

FIG. 6 is a diagram of another example of the color temperature changing process of converter 103 of the signal processing device in the first exemplary embodiment. FIG. 6 shows an example that if the RGB signals are set at the same level, the displayed color temperature is 9,000K. When the color temperature is to be lowered, converter 103 multiples each of the RGB signals by a predetermined gain to make a change in the direction of lowering the levels of the B signal and the G signal.

Figure 7:
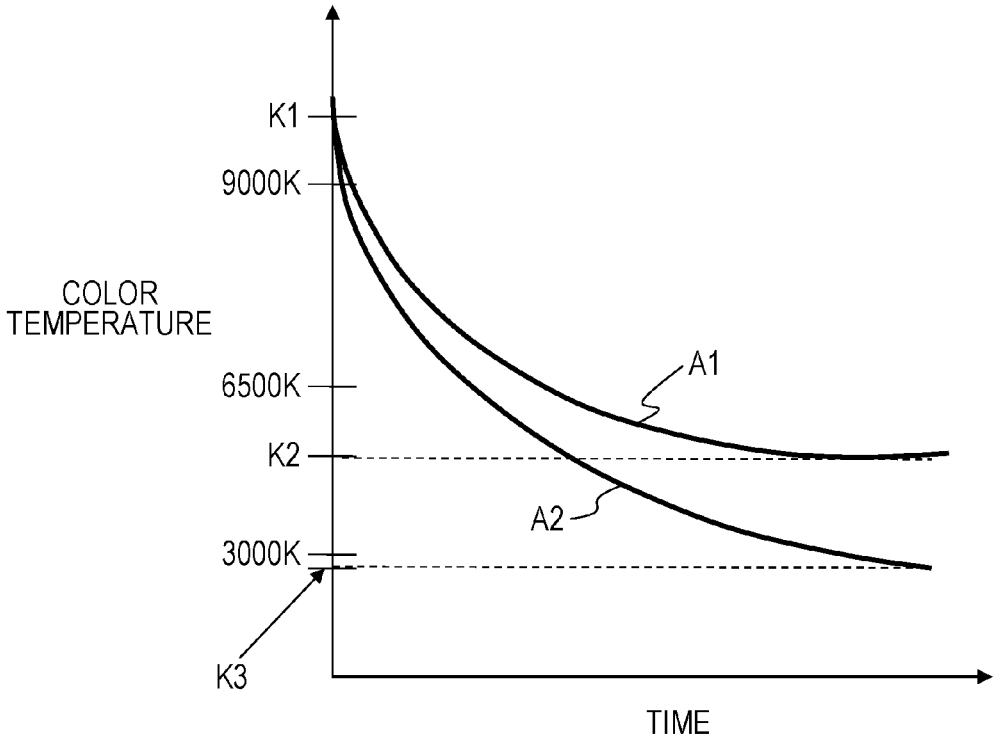
FIG. 7 is a diagram showing an example of color temperature change in the first exemplary embodiment.

FIG. 7 is a diagram showing an example of color temperature change in the first exemplary embodiment. FIG. 7 shows an example that converter 103 gradually performs the color temperature change, with lapse of time, to the target color temperature set by setting unit 102. FIG. 7 shows a color temperature A1 of the character area when the characters are warm-colored and a color temperature A2 of the character area when the characters are not warm-colored. If the characters are not warm-colored, setting unit 102 sets the target color temperature at the color temperature K3 reduced to a large extent from an original color temperature K1. If the characters are warm-colored, setting unit 102 sets the target color temperature at a color temperature K2 reduced to a small extent from the color temperature K1. The converter 103 gradually changes the color temperature A1 and the color temperature A2 to the target color temperature K2 and a target color temperature K3, respectively. As shown in FIG. 7, it can be seen that the color temperature A1 and the color temperature A2 gradually change with lapse of time, while drawing a large curve to the target color temperatures K2 and K3, respectively. By taking the advantage of adaptability that a user viewing display unit 105 adjusts to the color when the color temperature is gradually changed, it is possible to prevent the user from feeling strangeness.

[1-3. Advantageous Effect and the Like]

As described above, in the present exemplary embodiment, extraction unit 101 extracts, in the display area in which the content data is displayed, the character area, in which an area occupied by characters has a proportion greater than a predetermined value. Setting unit 102 sets a target color temperature obtained when the content data is displayed in accordance with color information of the characters in the character area extracted by extraction unit 101. Converter 103 changes the original color temperature of the content data to the target color temperature.

Further, setting unit 102 sets the target color temperature reduced to a large extent from the original color temperature when the color information does not indicates a warm color, and sets the target color temperature reduced to a small extent from the original color temperature when the color information indicates a warm color.

With this arrangement, when the characters are not warm-colored, it is possible to largely reduce a blue emission component, which is supposed to increase eye fatigue of a user. When the characters are warm-colored, it is possible to reduce a blue emission component, and at the same time it is possible to inhibit the warm-colored characters from being less easy to see due to lower contrast.

Second Exemplary Embodiment

In a second exemplary embodiment, description will be made on a case that the target color temperature is set, depending on the size of the character area in which warm-colored characters are displayed.

In the following, the second exemplary embodiment will be described with reference to FIG. 8 to FIG. 11.

[2-1. Configuration]

Figure 8:
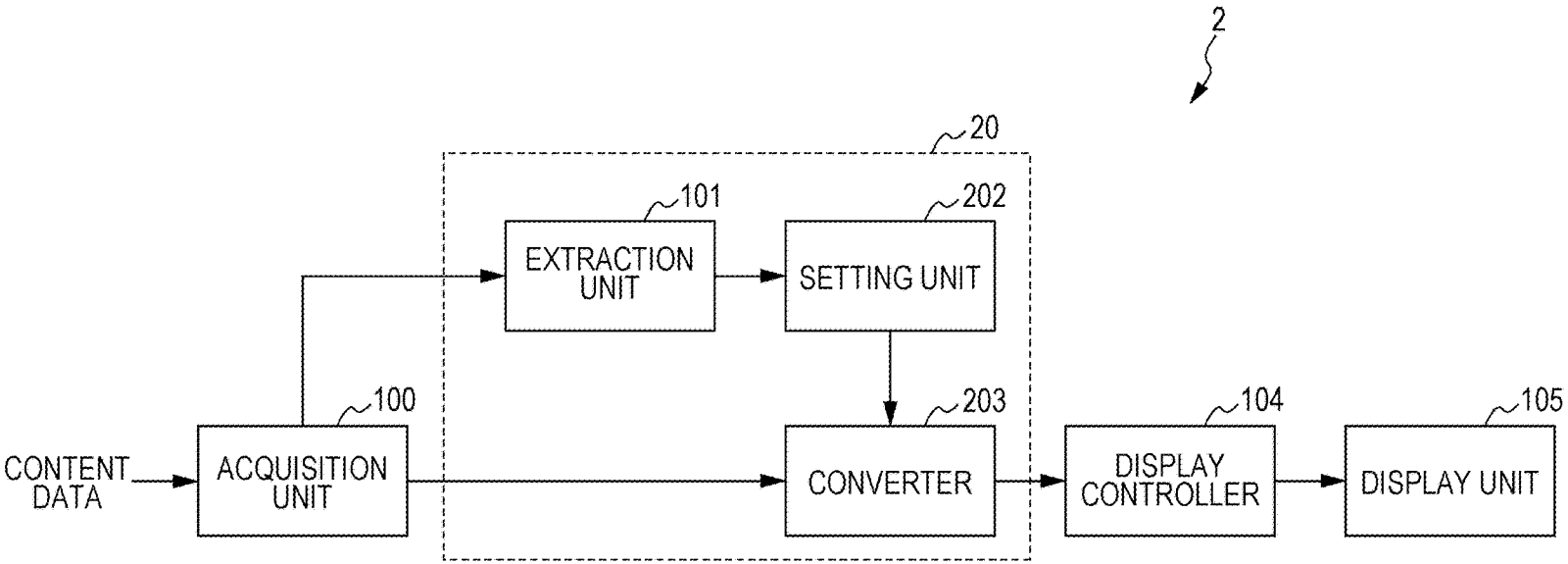
FIG. 8 is a block diagram showing a configuration example of a display apparatus having a signal processing device in a second exemplary embodiment.

FIG. 8 is a block diagram showing a configuration example of display apparatus 2 having a signal processing device in the second exemplary embodiment. As shown in FIG. 8, display apparatus 2 includes acquisition unit 100, signal processing device 20, display controller 104, and display unit 105. Signal processing device 20 includes extraction unit 101, setting unit 202, and converter 203. Here, for an element that performs the same operation as the first exemplary embodiment, the same reference numeral is given, and description is omitted. In the present exemplary embodiment, description will be made mainly on setting unit 202 and converter 203.

Setting unit 202 sets a target color temperature, depending on a proportion of an area with respect to a display area, where the area is determined to be a character area by extraction unit 101, and in the area warm colored characters exist.

Converter 203 changes an original color temperature of the display area to a target color temperature set by setting unit 202.

[2-2. Operation]

In the following, description will be made on an operation of signal processing device 20 configured as described above.

[2-2-1. Setting of Color Temperature in Setting Unit]

Figure 9:
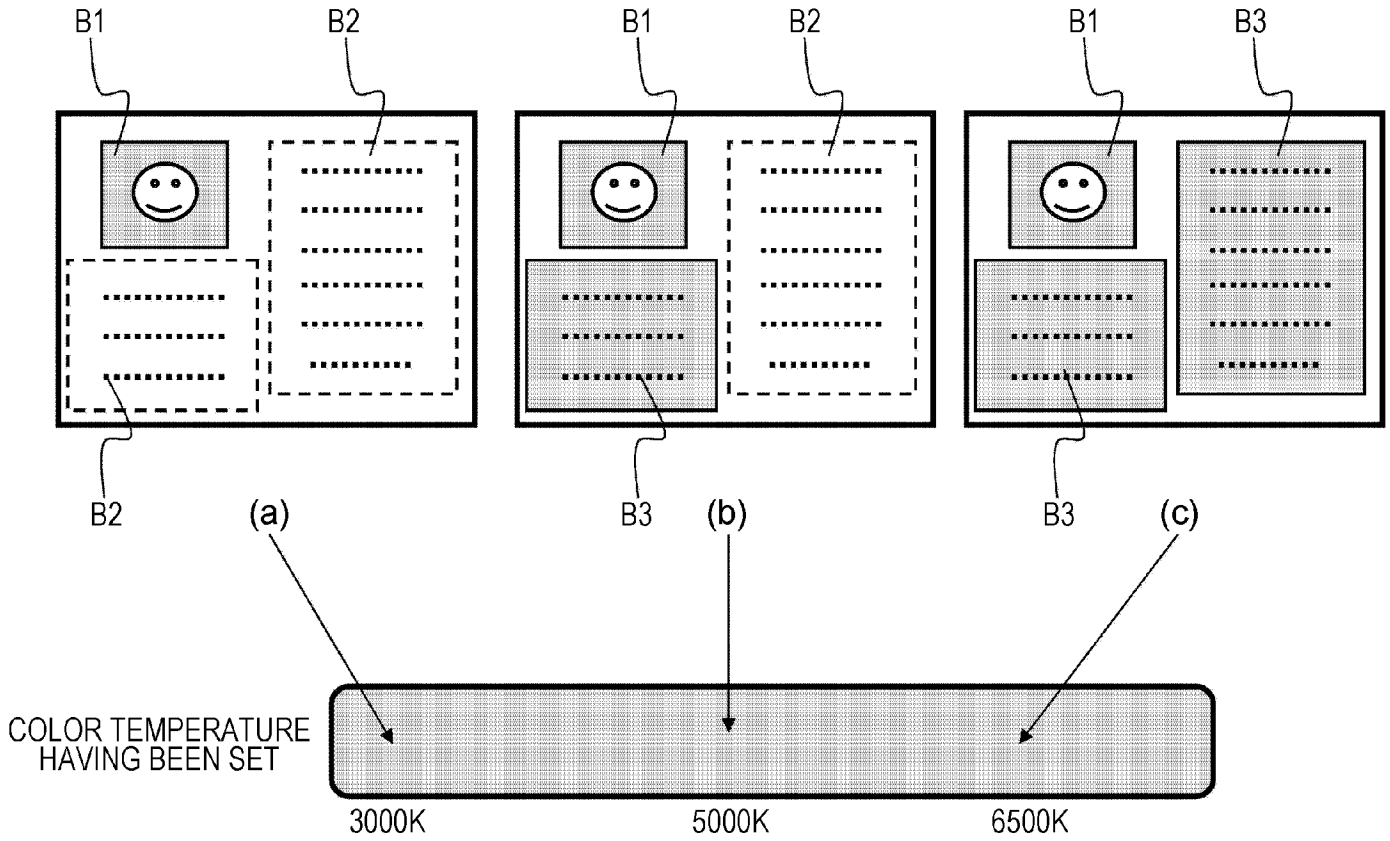
FIG. 9 is a diagram illustrating an example of how a setting unit of the signal processing device in the second exemplary embodiment sets the color temperature.

FIG. 9 is a diagram illustrating an example of how setting unit 202 of the signal processing device in the second exemplary embodiment sets the color temperature. FIG. 9 shows image area B1, second area B2 in which the proportion of the existing warm-colored characters is low, and first area B3 in which the proportion of the existing warm-colored characters is high. In the second exemplary embodiment, the original color temperature of the content data is 9,000K.

In FIG. 9, (a) shows the content data constituted by image area B1 and second area B2. In this case, because there is no first area B3, setting unit 202 sets the color temperature reduced to a large extent so as to set the target color temperature at 3,000 K, for example. In FIG. 9, (b) shows the content data constituted by image area B1, second area B2, and first area B3. In this case, second area B2 and the other areas have approximately the same size. Setting unit 202 sets the color temperature reduced to a smaller extent than in the case of (a) in FIG. 9 so as to set the target color temperature at 5,000K, for example. In FIG. 9, (c) shows the content data constituted by image area B1 and first area B3. In this case, because the proportion of first area B3 is high, setting unit 202 sets the color temperature reduced to a smaller extent than in the case of (b) in FIG. 9 so as to set the target color temperature at 6,500K, for example.

As shown in FIG. 9, setting unit 202 sets the color temperature to be higher as the proportion of first area B3, in which warm-colored characters exist, becomes higher in the content data. In other words, setting unit 202 sets the color temperature reduced to a smaller extent from the original color temperature with increase the proportion of first area B3, in which warm-colored characters exist.

Note that setting unit 202 may weight first area B3, depending on the size of the warm-colored characters in first area B3.

Figure 10:
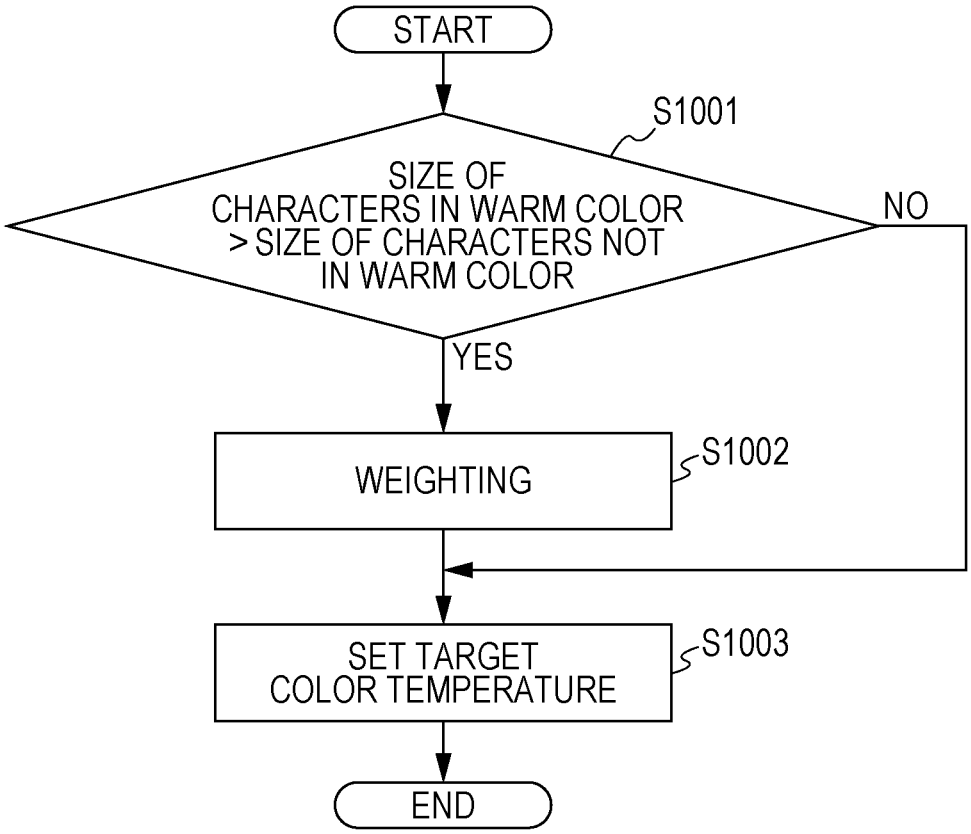
FIG. 10 is a flowchart illustrating another operation of the setting unit of the signal processing device in the second exemplary embodiment.

FIG. 10 is a flowchart illustrating another operation of setting unit 202 of the signal processing device in the second exemplary embodiment. Setting unit 202 compares the size of characters in warm color and the size of the characters not in warm color (step S1001), and if the size of the characters in warm color is larger, setting unit 202 weights the first area, in which the proportion of existing warm-colored characters is higher (S1002). Setting unit 202 sets the target color temperature of the display area, in consideration of the weighting (S1003). In this case, setting unit 202 deals with the weighting character area as an area smaller than the actual area. This is based on the fact that if characters in warm color have a larger size than character not in warm color, the characters in warm color are easy to see even when the color of the background becomes a warm color. By performing such a process, the target color temperature can be set at a lower value.

[2-2-2. Operation of Converter]

Figure 11:
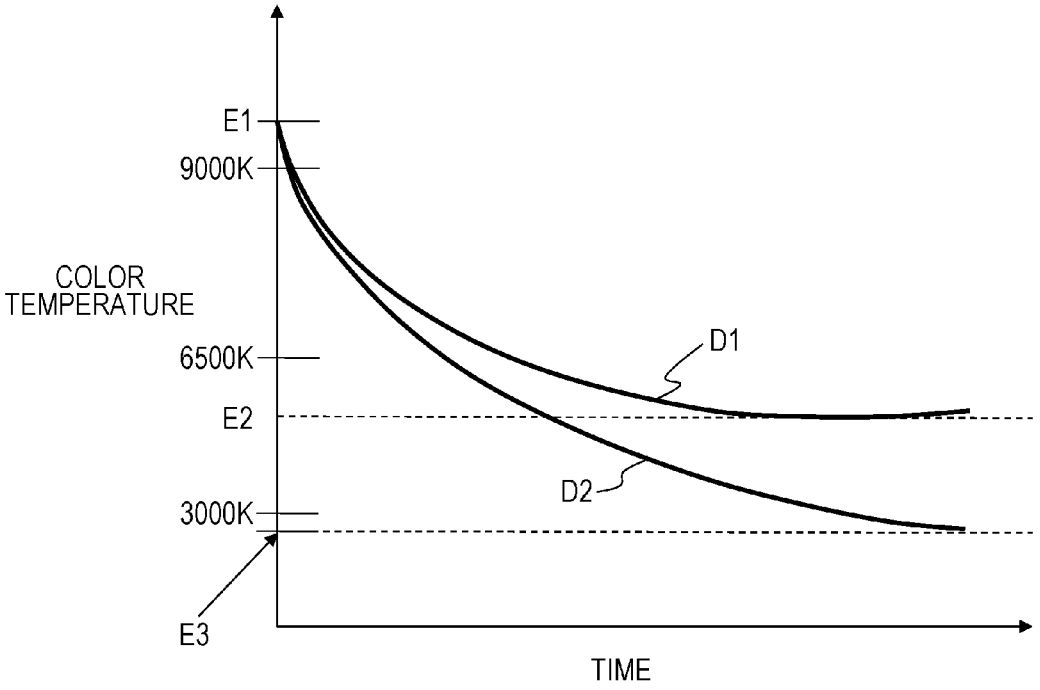
FIG. 11 is a diagram showing color temperature change in the second exemplary embodiment.

FIG. 11 is a diagram showing color temperature change in the second exemplary embodiment. FIG. 11 shows an example that converter 103 gradually performs the color temperature change, with lapse of time, to the target color temperature set by setting unit 202. FIG. 11 shows a color temperature D1 in the case that the first area, in which the proportion of existing warm-colored characters is high, is large and a color temperature D2 in the case that the first area is small. When the first area is small, setting unit 202 sets the target color temperature to be a color temperature E3 reduced to a large extent; and when the first area is large, setting unit 202 sets the target color temperature to be a temperature E2 reduced to a small extent. As shown in FIG. 11, converter 203 causes the color temperature D1 and the color temperature D2 to gradually change with lapse of time while drawing a large curve toward the target color temperature E2 and the target color temperature E3, respectively.

[2-3. Advantageous Effect and the Like]

As described above, in the present exemplary embodiment, setting unit 202 sets the target color temperature, depending on the proportion of the first area in the display area, the first area having a high proportion of existing warm-colored characters.

Further, setting unit 202 sets the target color temperature reduced to a smaller extent from the original color temperature with increase in the proportion of the first area.

With this arrangement, when the character area not in warm color is large in the content data, setting unit 202 sets the target color temperature reduced to a large extent; and when the character area in warm color is large, setting unit 202 sets the target color temperature reduced to a small extent.

With this arrangement, when the content has a large character area not in warm color, the blue emission component can be largely reduced.

Alternatively, when the character area in warm color is large, it is possible to reduce the blue emission component, and at the same time it is possible to inhibit the warm-colored characters from being less easy to see due to lower contrast.

In addition, setting unit 202 sets the proportion of the first area to be smaller as the size of the warm-colored characters in the character area becomes larger.

Setting unit 202 compares the size of the characters in warm color and the size of the characters not in warm color, and if the size of the characters in warm color is larger, setting unit 202 deals with the weighting character area as an area smaller than the actual area.

With this arrangement, when the warm-colored characters are large, the color temperature can be set to have a reduction range larger than the reduction range for the target color temperature in the case that the warm-colored characters is in a certain size. That is to say, it is possible to reduce the blue emission component further than by the processing in the case that the warm-colored characters are in a certain size, and at the same time it is possible to inhibit the warm-colored characters from being less easy to see due to lower contrast.

Third Exemplary Embodiment

In a third exemplary embodiment, description will be made on a case that the target color temperature is set depending on the contrast of the warm-colored characters.

In the following, a third exemplary embodiment will be described with reference to FIG. 12 to FIG. 14.

[3-1. Configuration]

Figure 12:
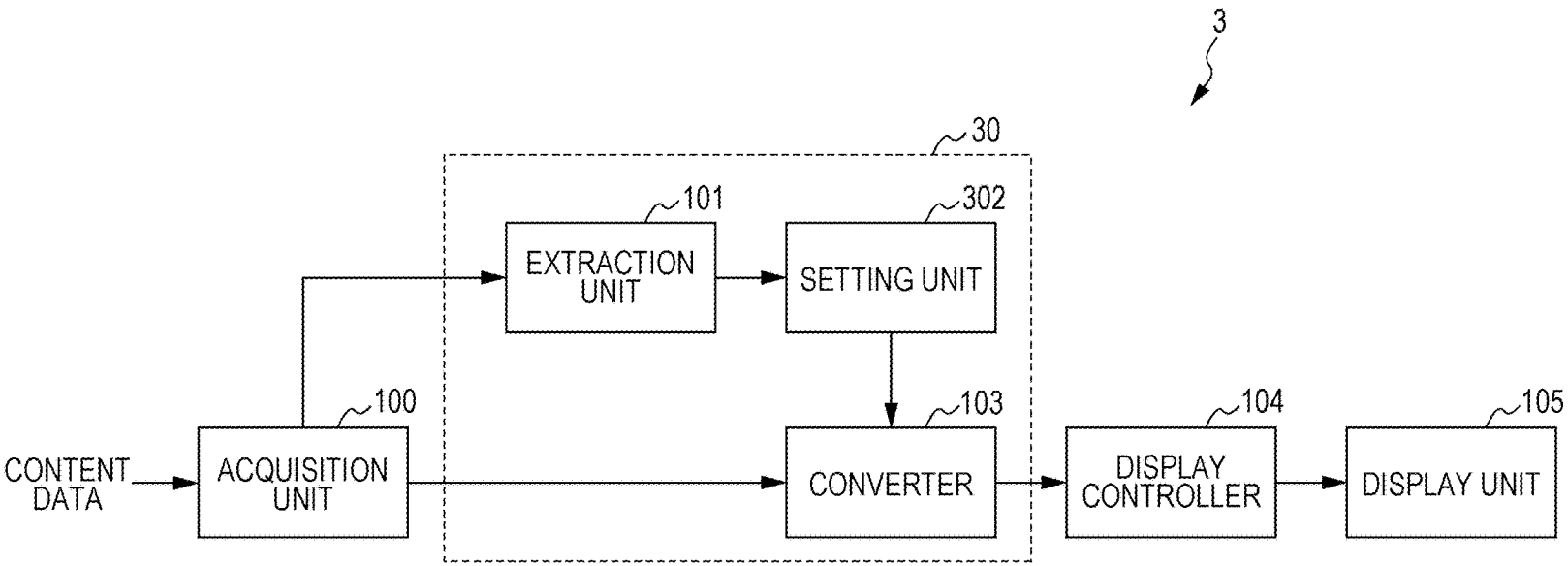
FIG. 12 is a block diagram showing a configuration of a display apparatus having a signal processing device in a third exemplary embodiment.

FIG. 12 is a block diagram showing a configuration of display apparatus 3 having signal processing devices in the third exemplary embodiment. As shown in FIG. 12, display apparatus 3 includes acquisition unit 100, signal processing device 30, display controller 104, and display unit 105. Signal processing device 30 includes extraction unit 101, setting unit 302, and converter 103. Here, for an element that performs the same operation as the first exemplary embodiment, the same reference numeral is given, and description is omitted. In the present exemplary embodiment, description will be made mainly on an operation of setting unit 302.

Setting unit 302 sets a target color temperature in consideration of a state of contrast of the warm-colored characters in a character area.

[3-2. Operation]

In the following, description will be made on an operation of display apparatus 30 configured as described above.

[3-2-1. Setting of Color Temperature in Setting Section]

Figure 13:
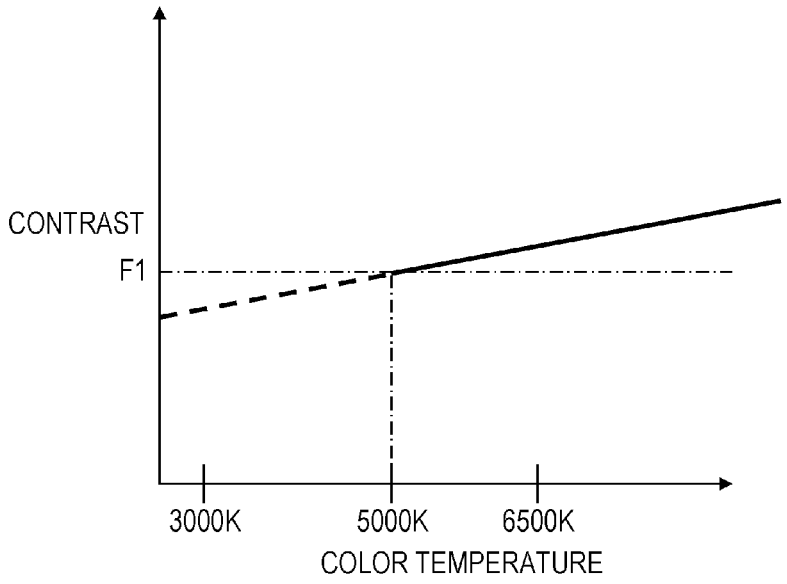
FIG. 13 is a diagram showing an example of a relationship between contrast and color temperature in the third exemplary embodiment.

FIG. 13 is a diagram showing an example of a relationship between contrast and color temperature in the third exemplary embodiment.

In FIG. 13, the horizontal axis represents a color temperature, and the vertical axis represents a contrast value of warm-colored characters. As shown in FIG. 13, when the color temperature is being lowered to the left in the horizontal direction, the contrast of the warm-colored characters is decreasing. The contrast reaches a predetermined lower limit F1 when the color temperature decreases to 5,000K. When the contrast has reached the lower limit F1, setting unit 302 sets the target color temperature at the color temperature of 5,000K at which the contrast reaches the lower limit F1, so that the contrast does not decrease further.

Figure 14:
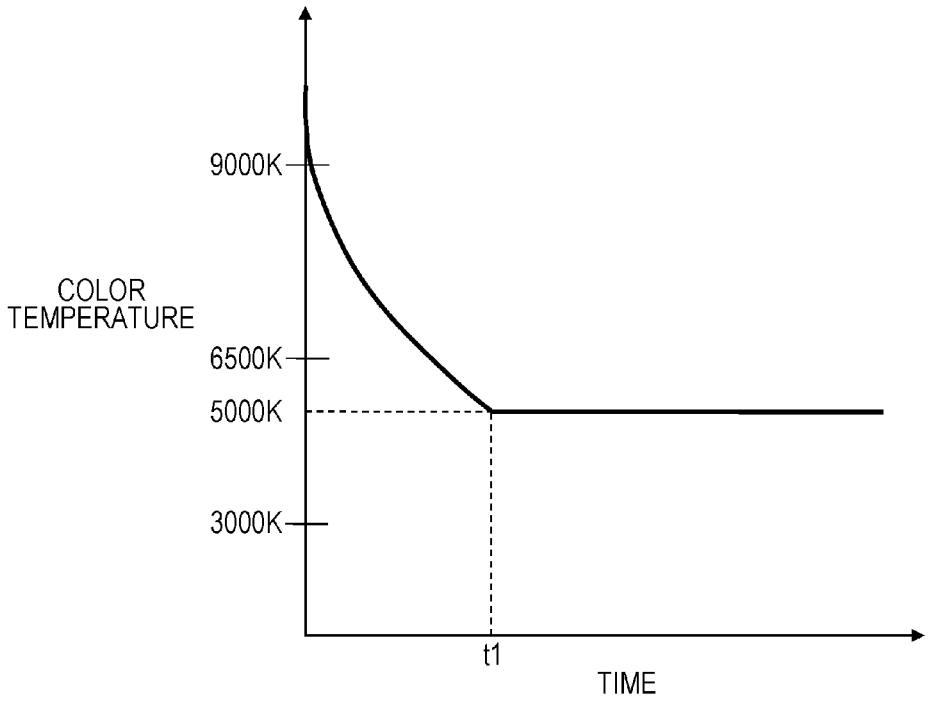
FIG. 14 is a diagram showing an example of color temperature change in the third exemplary embodiment.

FIG. 14 is a diagram showing an example of change in color temperature in the third exemplary embodiment.

As shown in FIG. 14, converter 103 gradually lowers the color temperature to the target color temperature. When the color temperature reaches 5,000K at time t1, converter 103 performs a process to keep the color temperature at 5,000K after that.

[3-3. Advantageous Effect and the Like]

As described above, in the present exemplary embodiment, setting unit 302 sets the target color temperature so that the contrast of the warm-colored characters in the character area does not become smaller than a predetermined value.

With this arrangement, it is possible to set the color temperature so that the contrast of the warm-colored characters in the content data does not become smaller than a predetermined value. Thus, it is possible to reduce the blue emission component, and at the same time it is possible to display such that the warm-colored characters is inhibited from being less easy to see due to lower contrast.

Fourth Exemplary Embodiment

In a fourth exemplary embodiment, description will be made on a case that a process is performed in which the target color temperature is set depending on the contrast of the warm-colored characters and in which the contrast of the warm-colored characters is increased.

In the following, the fourth exemplary embodiment will be described with reference to FIG. 15 to FIG. 17.

[4-1. Configuration]

Figure 15:
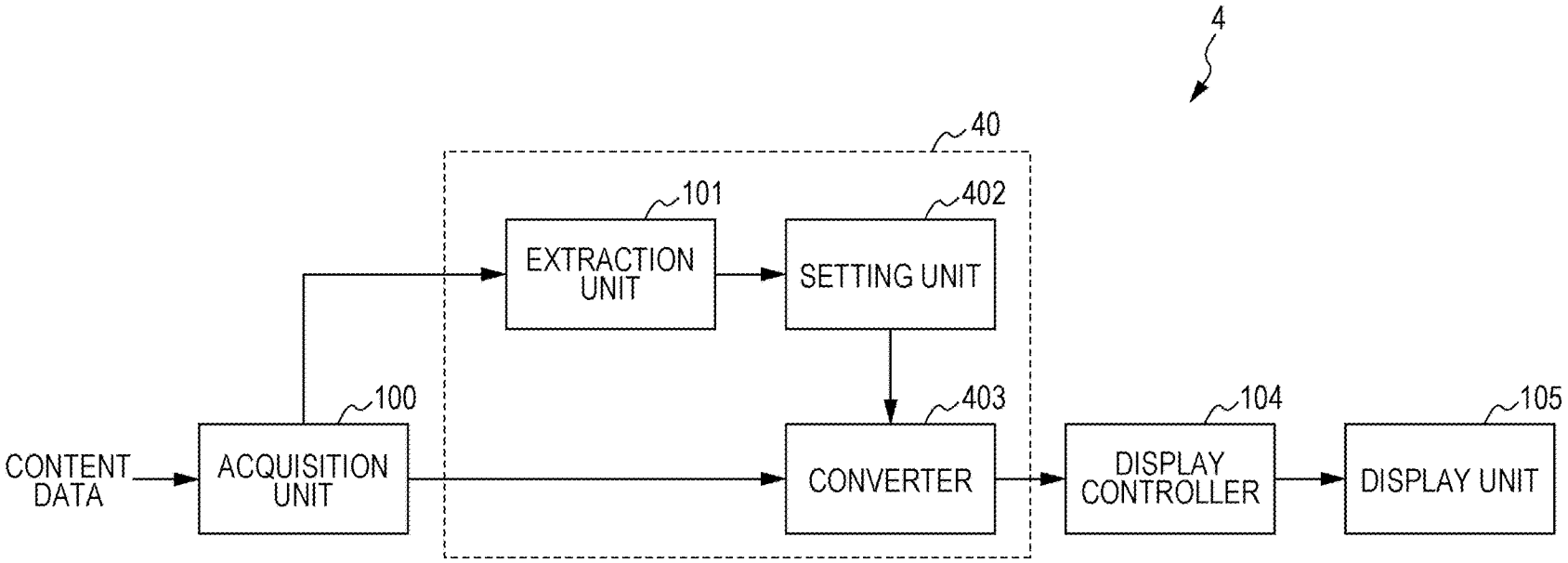
FIG. 15 is a block diagram showing a configuration of a display apparatus having a signal processing device in a fourth exemplary embodiment.

FIG. 15 is a block diagram showing a configuration of display apparatus 4 having a signal processing device in the fourth exemplary embodiment. As shown in FIG. 15, display apparatus 4 includes acquisition unit 100, signal processing device 40, display controller 104, and display unit 105. Signal processing device 40 includes extraction unit 101, setting unit 402, and converter 403. Here, for an element that performs the same operation as the first exemplary embodiment, the same reference numeral is given, and description is omitted. In the present exemplary embodiment, description will be made mainly on setting unit 402.

Setting unit 402 sets the target color temperature in consideration of the contrast of the warm-colored characters in the character area, and sets a content of conversion of the warm-colored characters to increase the contrast.

Converter 403 changes the color temperature of the content data to the target color temperature, and performs a conversion process on the warm-colored characters with respect to the contrast, depending on the content of the conversion.

[4-2. Operation]

An operation of signal processing device 40 configured as described above will be described below.

[4-2-1. Operations of Setting Unit and Converter]

Figure 16:
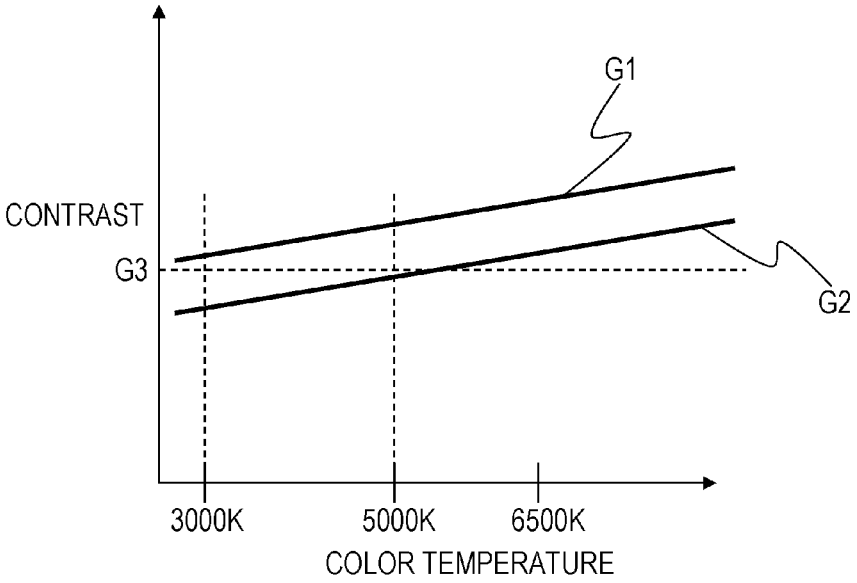
FIG. 16 is a diagram showing an example of a relationship between contrast and color temperature in the fourth exemplary embodiment.

FIG. 16 is a diagram showing an example of a relationship between contrast and color temperature in the fourth exemplary embodiment. In FIG. 16, the vertical axis represents a contrast value of warm-colored characters, and the horizontal axis represents a color temperature. In addition, FIG. 16 shows contrast value G2 of the warm-colored characters before converter 403 performs a process to increase the contrast, and shows contrast value G1 of the warm-colored characters after converter 403 has performed a process to increase the contrast. The symbol G3 represents a predetermined lower limit of contrast value.

When the color temperature is being lowered to the left in the horizontal direction as shown in FIG. 16, the contrast value of the warm-colored characters are also decreasing. When the color temperature decreases to 5,000K, the contrast value G2 reaches the lower limit G3. At this time, when a process to increase the contrast of the warm-colored characters is performed, the contrast value G2 becomes the value of the contrast value G1; thus, even if the color temperature is lowered to about 3,000K, the contrast can be kept greater than the lower limit G3 of contrast.

In this case, setting unit 402 sets the target color temperature to be 3,000K. Further, setting unit 402 sets the first color temperature of 5,000K, at which the contrast value reaches the lower limit, and the content of conversion to increase the contrast value.

Figure 17:
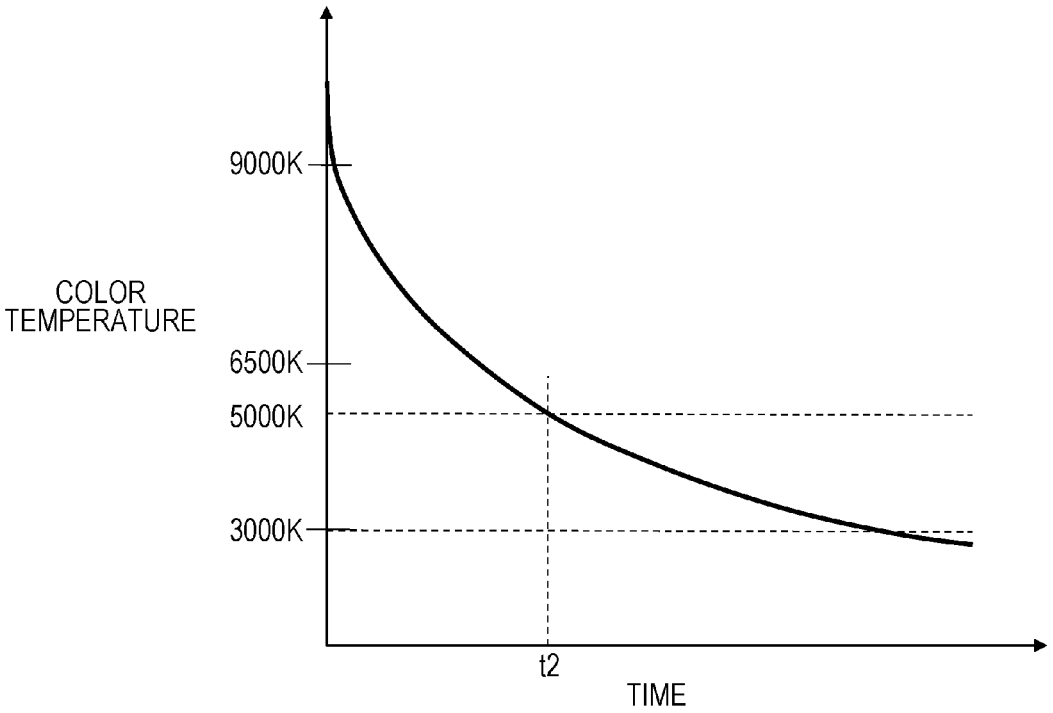
FIG. 17 is a diagram showing color temperature change in the fourth exemplary embodiment.

FIG. 17 is a diagram showing color temperature change in the fourth exemplary embodiment. Converter 403 gradually lowers the color temperature of the content data toward the target color temperature of 3,000K. Further, converter 403 performs on the warm-colored characters a process to increase the contrast when the color temperature reaches 5,000K at the time t2.

Here, the process to increase the contrast of the characters includes a process in which a luminosity ratio between the characters and the background is changed and a process in which saturation or hue of the characters are changed.

[4-3. Advantageous Effect and the Like]

As described above, in the present exemplary embodiment, setting unit 402 sets the target color temperature when the content data is displayed, in consideration of the contrast of the warm-colored character in the character area. Further, setting unit 402 sets the first color temperature at which the contrast of the warm-colored characters in the character area becomes a predetermined value and the content of conversion. Converter 403 changes the color temperature of the content data to the target color temperature. Further, converter 403 performs a process to increase the contrast of the warm-colored character when setting unit 402 lowers the color temperature lower than the first color temperature.

With this arrangement, it is possible to prevent the contrast value of the warm-colored characters from being smaller than the predetermined value when the color temperature at the time of displaying the content data is lowered.

Thus, it is possible to reduce the blue emission component, and at the same time it is possible to display such that the warm-colored characters is inhibited from being less easy to see due to lower contrast.

The exemplary embodiments are described above as examples of the technology in the present disclosure. For that purpose, the accompanying drawings and the detailed description are provided.

Therefore, the components described in the accompanying drawings and in the detailed description can include not only components necessary to solve the problems but also components unnecessary to solve the problems. For this reason, it should not be immediately recognize that those unnecessary components are necessary, based on the fact that those unnecessary components are described in the accompanying drawings and the detailed description.

In addition, because the above exemplary embodiments are for exemplifying the technology in the present disclosure, various modifications, replacements, additions, or removals can be made without departing from the scope of the accompanying claims or the equivalent thereof.

The present disclosure is applicable to a signal processing device having a display unit. Specifically, the present disclosure is applicable to a display for a personal computer, a display for airplane use, a tablet terminal, a head-mounted display, a smartphone, and the like.

What is claimed is:

1. A signal processing method comprising:

extracting, in a display area in which content data is displayed, a character area in which an area occupied by a character has a proportion greater than a predetermined value;

setting, when color information of the character in the character area indicates a warm color, based on the color information, a target color temperature when the content data is displayed;

changing an original color temperature of the content data to the target color temperature; and displaying the content data having the target color temperature in the display area, wherein in the setting, the target color temperature is set reduced to a smaller extent from the original color temperature than an extent of reduction when the color information does not indicate a warm color.

* * * * *